US009748027B2

(12) United States Patent
Nakanishi et al.

(10) Patent No.: US 9,748,027 B2
(45) Date of Patent: Aug. 29, 2017

(54) METHOD FOR MANUFACTURING NON-ORIENTED ELECTROMAGNETIC STEEL SHEET

(71) Applicant: JFE STEEL CORPORATION, Tokyo (JP)

(72) Inventors: Tadashi Nakanishi, Kurashiki (JP); Yoshiaki Zaizen, Kurashiki (JP); Yoshihiko Oda, Fukuyama (JP); Hiroaki Toda, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 357 days.

(21) Appl. No.: 14/413,589

(22) PCT Filed: Aug. 8, 2013

(86) PCT No.: PCT/JP2013/004792

§ 371 (c)(1),
(2) Date: Jan. 8, 2015

(87) PCT Pub. No.: WO2014/027452

PCT Pub. Date: Feb. 20, 2014

(65) Prior Publication Data

US 2015/0136278 A1 May 21, 2015

(30) Foreign Application Priority Data

Aug. 17, 2012 (JP) ..... 2012-181014

(51) Int. Cl.
*H01F 1/14* (2006.01)
*C22C 38/60* (2006.01)
(Continued)

(52) U.S. Cl.
CPC ..... *H01F 1/14775* (2013.01); *B22D 11/001* (2013.01); *C21D 8/1205* (2013.01);
(Continued)

(58) Field of Classification Search
CPC ..... H01F 1/14775; H01F 1/16; C21D 8/1233; C21D 8/1261; C21D 28/001;
(Continued)

(56) References Cited

U.S. PATENT DOCUMENTS 6,436,199 B1 8/2002 Hayakawa et al.
2003/0024606 A1 2/2003 Hayakawa et al.
2009/0202383 A1* 8/2009 Tanaka ..... C22C 38/004 420/83

FOREIGN PATENT DOCUMENTS

CN 1887512 A 1/2007
CN 100999050 A 7/2007
(Continued)

OTHER PUBLICATIONS

Machine generated translation of JP2012136764, geenrated Feb. 15, 2017, pp. 1-20.*
(Continued)

*Primary Examiner* — Colleen Dunn
(74) *Attorney, Agent, or Firm* — Oliff PLC

(57) ABSTRACT

Provided is a method for stably obtaining a non-oriented electrical steel sheet with high magnetic flux density and excellent productivity, at a low cost by casting in a continuous casting machine a slab having a chemical composition including by mass %, C≤0.0050%, 3.0%<Si≤5.0%, Mn≤0.10%, Al≤0.0010%, 0.040%<P≤0.2%, N≤0.0040%, 0.0003%≤S≤0.0050%, Ca≤0.0015%, and total of at least one element selected from Sn and Sb: 0.01% or more and 0.1% or less, balance including Fe and incidental impurities, subjecting the slab to heating, then subjecting the slab to hot rolling to obtain a hot rolled steel sheet, then subjecting the steel sheet to hot band annealing, pickling, subsequent single cold rolling to obtain a final sheet thickness, then subjecting the steel sheet to final annealing, wherein in the hot band
(Continued)

annealing, soaking temperature is 900° C. or higher and 1050° C. or lower, and cooling rate after soaking is 5° C/s or more.

5 Claims, 3 Drawing Sheets

(51) Int. Cl.

| | |
|---|---|
| ***H01F 1/16*** | (2006.01) |
| ***H01F 1/147*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| *B22D 11/00* | (2006.01) |
| *C21D 8/12* | (2006.01) |

(52) U.S. Cl.
CPC ..... *C21D 8/1233* (2013.01); *C21D 8/1261* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/16* (2013.01); *B22D 11/00* (2013.01); *C21D 8/1222* (2013.01)

(58) Field of Classification Search
CPC .. C21D 28/002; C21D 28/004; C21D 28/008; C21D 28/02; C21D 28/04; C21D 28/06
See application file for complete search history.

(56) References Cited

FOREIGN PATENT DOCUMENTS

| | | | |
|---|---|---|---|
| CN | 101333620 | A | 12/2008 |
| CN | 102383037 | A | 3/2012 |
| JP | S63-210237 | A | 8/1988 |
| JP | H05-171280 | A | 7/1993 |
| JP | B2-6-80169 | | 10/1994 |
| JP | B2-2500033 | | 5/1996 |
| JP | H08295936 | A | 11/1996 |
| JP | A-2001-247943 | | 9/2001 |
| JP | 2001-316729 | A | 11/2001 |
| JP | 2004-183002 | A | 7/2004 |
| JP | 2007-016278 | A | 1/2007 |
| JP | B2-3870893 | | 1/2007 |
| JP | A-2007-162096 | | 6/2007 |
| JP | B2-4126479 | | 7/2008 |
| JP | A-2010-24509 | | 2/2010 |
| JP | 2012-136764 | * | 7/2012 |
| JP | A-2012-136764 | | 7/2012 |
| JP | A-2012-149337 | | 8/2012 |
| TW | 200932927 | A | 8/2009 |
| WO | 2007/069776 | A1 | 6/2007 |
| WO | 2012-055223 | A1 | 5/2012 |

OTHER PUBLICATIONS

Jan. 26, 2016 Office Action issued in Japanese Patent Application No. 2012-181014.
Feb. 23, 2016 Office Action issued in Korean Patent Application No. 10-2015-7003911.
Oct. 25, 2016 Office Action issued in Korean Patent Application No. 10-2015-7003911.
Apr. 26, 2016 Office Action issued in Chinese Patent Application No. 201380042289.7.
Aug. 5, 2016 Office Action issued in Korean Patent Application No. 10-2015-7003911.
Aug. 27, 2015 Extended Search Report issued in European Patent Application No. 13879576.0.
Sep. 25, 2015 Office Action issued in Chinese Patent Applicaiton No. 201380042289.7.
Feb. 14, 2017 Office Action issued in Korean Patent Application No. 10-2017-7001556.
Oct. 22, 2013 International Search Report issued in International Patent Application No. PCT/JP2013/004792 (with translation).
Aug. 25, 2014 Office Action issued in Taiwanese Patent Application No. 102129279 (with translation).

* cited by examiner

METHOD FOR MANUFACTURING NON-ORIENTED ELECTROMAGNETIC STEEL SHEET

TECHNICAL FIELD

The present invention relates to a method for manufacturing a non-oriented electromagnetic (electrical) steel sheet with high magnetic flux density, which is suitably used as material for cores of motors, typical examples of such motors being driving motors for electric automobiles and hybrid automobiles, and motors for generators.

BACKGROUND ART

In recent years, practical use of hybrid automobiles and electric automobiles is increasing, and regarding driving motors and motors for generators used in these automobiles, strong demands are being made for higher efficiency and higher output.

Further, the development of driving systems for motors has made frequency control of the driving power source possible, and motors for variable speed operation or high speed rotation exceeding commercial frequency are increasing.

Therefore, strong demands are being made for higher efficiency and higher output, i.e. lower iron loss and higher magnetic flux density for non-oriented electrical steel sheets for iron cores used in motors such as above as well.

In order to reduce iron loss of non-oriented electrical steel sheets, a means of reducing eddy current loss by increasing the contents of for example, Si, Al, and Mn, etc. and increasing electric resistance has been generally used. However, with this means, there was a problem in that a decrease of magnetic flux density cannot be avoided.

Under the situation, some proposals for methods for improving the magnetic flux density of non-oriented electrical steel sheets have been made.

For example, JPH680169B (PTL 1) proposes a method for obtaining a higher magnetic flux density by setting the P content to 0.05% to 0.20% and Mn content to 0.20% or less. However, when these methods were applied to factory production, there were problems such as the fact that troubles including sheet breakage were likely to occur during the rolling process, etc., and reduction in yield or line stop was unavoidable. Further, since the Si content is a low amount of 0.1% to 1.0%, iron loss was high, and iron loss properties in a high frequency were particularly poor.

Further, JP4126479B (PTL 2) proposes a method of obtaining a higher magnetic flux density by setting the Al content to 0.017% or less. However, with this method, sufficient improving effect of magnetic flux density could not be obtained from a single cold rolling at room temperature. Regarding this point, by performing cold rolling as warm rolling with a sheet temperature of around 200° C., although magnetic flux density will improve, there was a problem in that adaptation of equipment for warm rolling or process management due to restriction of production would be necessary. Further, cold rolling of twice or more with intermediate annealing performed therebetween would increase manufacturing costs.

Further, as elements other than the above elements, the addition of Sb and Sn are known to be effective for obtaining higher magnetic flux density, and for example, JP2500033B (PTL 3) discloses such effect.

On the other hand, as a manufacturing method, JP3870893B (PTL 4) discloses a technique for performing hot band annealing as box annealing on a material with P content of more than 0.07% and 0.20% or less, and setting the grain diameter before cold rolling to a particular range. However, with this method, it is necessary to set the soaking temperature of hot band annealing to a fixed range in order to set the grain diameter before cold rolling to a certain range. Therefore, if continuous annealing which is excellent in productivity is applied, in particular, when the preceding or succeeding steel is a different type from the steel in question, there was a problem in that variation in properties increases. Further, PTL4 discloses that better magnetic properties can be obtained by performing hot band annealing at a low temperature for a long period and setting a low cooling rate.

As mentioned above, with conventional techniques, it is difficult to stably provide non-oriented electrical steel sheets having high magnetic flux density and excellent productivity (manufacturability) using material with sufficiently low eddy current loss and Si content exceeding 3.0%, at a low cost.

CITATION LIST

Patent Literature

PTL 1: JPH680169B
PTL 2: JP4126479B
PTL 3: JP2500033B
PTL 4: JP3870893B

SUMMARY OF INVENTION

Technical Problem

The present invention has been developed in light of the above circumstances, and it is an object thereof to provide a manufacturing method that enables stably obtaining a non-oriented electrical steel sheet with excellent magnetic flux density and iron loss properties, at a low cost.

Solution to Problem

In order to resolve the above problem, using as the material a steel sheet that can sufficiently reduce eddy current loss with an Si content of more than 3.0%, and moreover with reduced Mn content, at the same time extremely reduced Al content, and added Sn, Sb and P to improve magnetic flux density, the inventors continued research for a manufacturing method of non-oriented electrical steel sheets comprising processes of hot band annealing in a continuous annealing furnace and a single cold rolling to improve productivity and reduce manufacturing costs.

As a result, the inventors discovered that in order to improve productivity, it is advantageous to add an appropriate amount of Ca, and at the same time, increase the cooling rate in hot band annealing, and that it is effective to control the surface temperature at the center part of slab width in the straightening zone right after the slab passes through the curved zone particularly when using a curved continuous casting machine for continuous casting.

The present invention is based on the above-mentioned findings.

The main features of the present invention are as follows.

1. A method for manufacturing a non-oriented electrical steel sheet, the method comprising:

casting in a continuous casting machine a slab having a chemical composition including by mass %

C: 0.0050% or less,

Si: more than 3.0% and 5.0% or less,

Mn: 0.10% or less,

Al: 0.0010% or less,

P: more than 0.040% and 0.2% or less,

N: 0.0040% or less,

S: 0.0003% or more and 0.0050% or less,

Ca: 0.0015% or more, total of at least one element selected from Sn and Sb: 0.01% or more and 0.1% or less, and the balance including Fe and incidental impurities, subjecting the slab to heating, then subjecting the slab to hot rolling to obtain a hot rolled steel sheet, then subjecting the steel sheet to hot band annealing, pickling, subsequent single cold rolling to obtain a final sheet thickness, then subjecting the steel sheet to final annealing, wherein in the hot band annealing, soaking temperature is 900° C. or higher and 1050° C. or lower, and cooling rate after soaking is 5° C./s or more.

2. The method for manufacturing a non-oriented electrical steel sheet according to aspect 1, wherein if the continuous casting machine is a curved continuous casting machine, the surface temperature at a center part of slab width in a straightening zone right after the slab passes through a curved zone is set to be 700° C. or higher.

3. The method for manufacturing a non-oriented electrical steel sheet according to aspects 1 or 2, wherein the hot band annealing is performed as continuous annealing, and the difference between the maximum temperature and the minimum temperature of soaking temperature in a hot rolled sheet coil is 10° C. or more.

Advantageous Effect of Invention

According to the present invention, it is possible to stably obtain a non-oriented electrical steel sheet with excellent magnetic flux density and iron loss properties, at a low cost.

BRIEF DESCRIPTION OF DRAWINGS

The present invention will be further described below with reference to the accompanying drawings, wherein.

DESCRIPTION OF EMBODIMENTS

Figure 1:
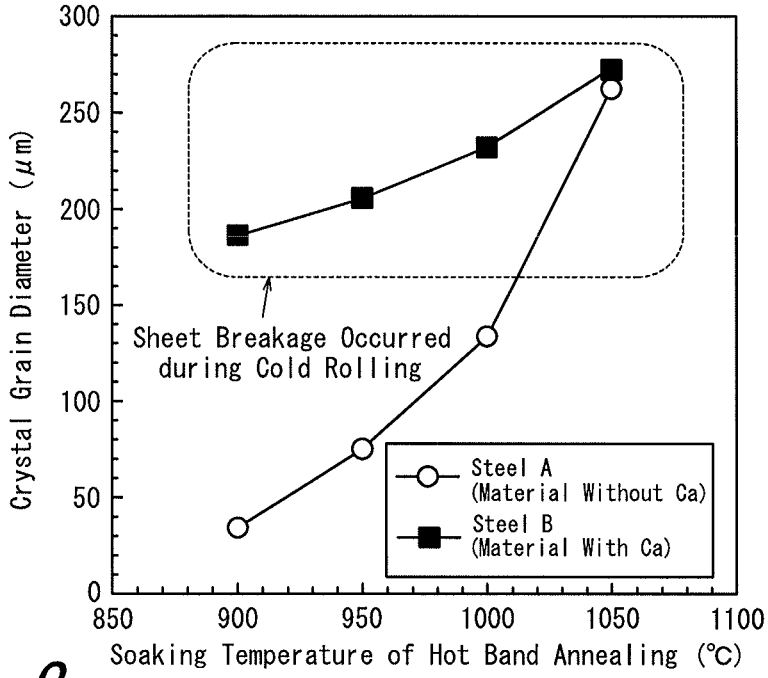
FIG. 1 is a graph indicating the influence of the soaking temperature of hot band annealing on crystallized grain diameter.

The present invention will be specifically described below.

First, the history of how the present invention has been achieved will be described.

In order to sufficiently reduce iron loss, the inventors of the present invention decided to consider a material with an Si amount exceeding 3.0%. If the Si amount exceeds 3.0%, the magnetic flux density decreases. Therefore, as a measure for enhancing magnetic flux density by improving the texture, conventional techniques were taken into consideration, and it was decided to set the Al content very low, add Sn and/or Sb, add P, and reduce Mn content.

Under the above described situation, the inventors performed experiments using steel slabs (steel A) with a composition including 3.3% of Si, 0.03% of Mn, 0.0005% of Al, 0.09% of P, 0.0018% of S, 0.0015% of C, 0.0017% of N, and 0.03% of Sn. Here, unless otherwise specified, the indication of "%" regarding components shall stand for "mass %".

However, after heating the above steel slabs at 1100° C., a problem arose in that sheet breakage occurred in some of the materials during hot rolling to a thickness of 2.0 mm. In order to determine the cause of sheet breakage, an investigation was made on the broken sheet in the middle of hot rolling, and as a result, concentration of S was observed in the crack part. Further, since no concentration of Mn was found in the S concentration part, it is considered that the concentrated S formed into FeS in liquid phase during hot rolling, and caused the sheet breakage.

Therefore, in order to prevent such sheet breakage, it is considered that S content should be reduced. However, for manufacturing reasons, there is a limit in reducing S content. Further, an increase in cost due to desulfurization would become another problem. An alternative would be to increase Mn content. However, in order to enhance magnetic flux density, it is necessary to reduce the Mn content.

As a solution to this problem, the inventors came to think that, by adding Ca to precipitate as CaS, FeS in liquid phase would be reduced, and it would be possible to prevent sheet breakage during hot rolling. Based on this approach, the following experiment was conducted.

Steel slabs (steel B) with a composition including 3.3% of Si, 0.03% of Mn, 0.0005% of Al, 0.09% of P, 0.0018% of S, 0.0017% of C, 0.0016% of N, 0.03% of Sn, 0.0030% of Ca were heated at 1100° C., and then subjected to hot rolling to a thickness of 2.0 mm. As a result, no sheet breakage occurred during hot rolling.

Next, the previously mentioned material without Ca, and the above mentioned material with Ca were subjected to hot band annealing at 900° C., 950° C., 1000° C., and 1050° C. The cooling rate after hot band annealing was set to 4° C./s. Then, after pickling, the hot rolled sheets were subjected to cold rolling to a sheet thickness of 0.25 mm, and a problem arose in that sheet breakage occurred in some of the materials. Regarding material with Ca, sheet breakage occurred in some of the materials regardless of the soaking temperature of hot band annealing. Regarding material without Ca, sheet breakage occurred in some of the materials in cases where the soaking temperature of hot band annealing was 1050° C.

Investigation on the microstructure of the hot rolled sheets before cold rolling was performed in order to clarify the cause of the sheet breakage, and the results are shown in FIG. 1. FIG. 1 shows the relation between the soaking temperature in hot band annealing and the crystal grain diameter of the hot rolled sheet after annealing, and cases where sheet breakage occurred are surrounded by broken lines.

From FIG. 1, it was found that sheet breakage occurred in cases where the materials have a coarse grain before cold rolling. It is considered that, since fine precipitates of MnS are not formed in material with Ca, the grain before cold rolling as a whole became coarse, and therefore sheet breakage occurred during cold rolling.

From the above, the inventors ascertained that, although adding Ca is effective for preventing sheet breakage during hot rolling, it does more harm than good in preventing sheet breakage during cold rolling. For this reason, it seemed difficult to prevent sheet breakage during both hot rolling and cold rolling at the same time by adding Ca.

However, the inventors came to think that grain boundary segregation of P is related to sheet breakage during cold rolling, and thought that by increasing the cooling rate of hot band annealing and reducing the amount of grain boundary segregation of P, it may be possible to prevent sheet breakage during cold rolling.

Regarding the increase of the cooling rate of hot band annealing, there was a possibility of deteriorating magnetic properties, as disclosed in PTL 4. However, since no actual examples of changing the cooling rate was provided in PTL4, the inventors decided to perform actual experiments.

Steel slab C (material without Ca) and steel slab D (material with Ca) having compositions shown in table 1 were heated at 1100° C., and then subjected to hot rolling to a thickness of 2.0 mm. Then, these hot rolled sheets were treated at soaking temperatures of 900° C., 950° C., 1000° C., 1050° C. and then cooled at a cooling rate of 32° C./s. Further, separately from the above, the hot rolled sheets made from steel slabs C and D were subjected to hot band annealing where the soaking temperature was set to 1000° C. and the cooling rate was variously set to 4° C./s, 8° C./s, 16° C./s, and 32° C./s. Then, after pickling these hot rolled sheets, they were subjected to cold rolling to a sheet thickness of 0.25 mm, and then to final annealing at a temperature of 1000° C.

TABLE 1

| Steel | Chemical Composition (mass %) | | | | | | | | | |
|---|---|---|---|---|---|---|---|---|---|---|
| Sample | C | Si | Mn | Al | P | S | N | Sn | Ca | Remarks |
| C | 0.0018 | 3.3 | 0.03 | 0.0004 | 0.08 | 0.0016 | 0.0018 | 0.04 | — | Comparative Steel |
| D | 0.0019 | 3.3 | 0.03 | 0.0005 | 0.08 | 0.0018 | 0.0018 | 0.04 | 0.003 | Conforming Steel |

As a result, sheet breakage occurred in some of the materials of material without Ca during the hot rolling process. Further, in the cold rolling process, sheet breakage occurred in some of the materials with Ca where a cooling rate in hot band annealing was 4° C./s, but not in those where a cooling rate was 8° C./s or more.

This means that, as it was expected by the inventors as above, the inventors were able to discover that, even with material with Ca, by increasing the cooling rate in hot band annealing, it is possible to prevent sheet breakage during cold rolling.

Further, the magnetic properties of the obtained product steel sheets were investigated. The magnetic properties were evaluated based on $B_{50}$ (magnetic flux density at magnetizing force: 5000 A/m) and $W_{10/400}$ (iron loss when excited at magnetic flux density: 1.0 T and frequency: 400 Hz) of (L+C) properties by measuring Epstein test specimens in the rolling direction (L) and the transverse direction (direction orthogonal to the rolling direction) (C).

Figure 2:
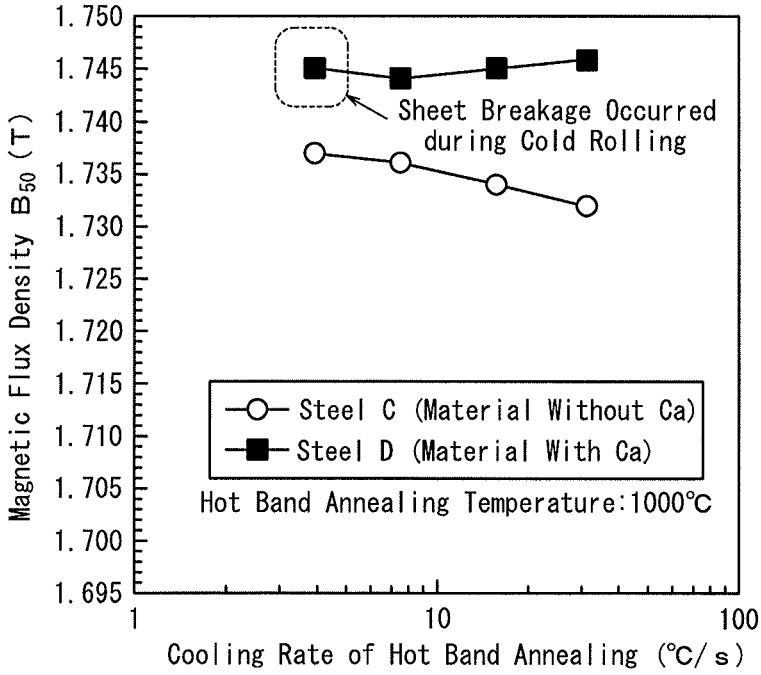
FIG. 2 is a graph indicating the influence of the cooling rate of hot band annealing on magnetic flux density $B_{50}$.
Figure 3:
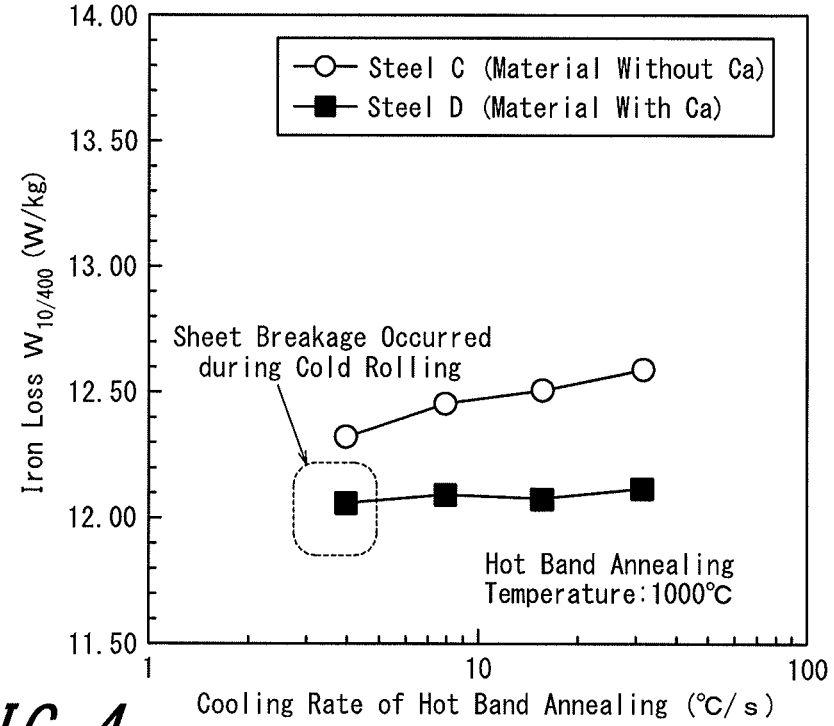
FIG. 3 is a graph indicating the influence of the cooling rate of hot band annealing on iron loss $W_{10/400}$.

FIGS. 2 and 3 each show the results of investigating the influence of the cooling rate of hot band annealing on magnetic flux density $B_{50}$ and iron loss $W_{10/400}$.

As shown in FIGS. 2 and 3, while as for material without Ca, the magnetic properties tended to slightly deteriorate as the cooling rate increased, as for material with Ca, magnetic properties did not deteriorate as the cooling rate increased.

Although the reason for the above is not necessarily clear, the inventors think as follows.

According to PTL4, it was considered that due to the decrease in cooling rate, fine precipitates would be reduced, and therefore magnetic properties would be improved.

Generally, if the Al content is very low, the fine precipitate is considered to be MnS. However, in the case of material with Ca such as in the present invention, it is considered that fine MnS does not exist because S is coarsely precipitated as CaS. Therefore, it is considered that magnetic properties deteriorate as the cooling rate increases, only in material without Ca. From the above, it is considered that with the material with Ca of the present invention, deterioration of magnetic properties will not occur even if the cooling rate of hot band annealing increases, and further, sheet breakage during cold rolling can be prevented.

Figure 4:
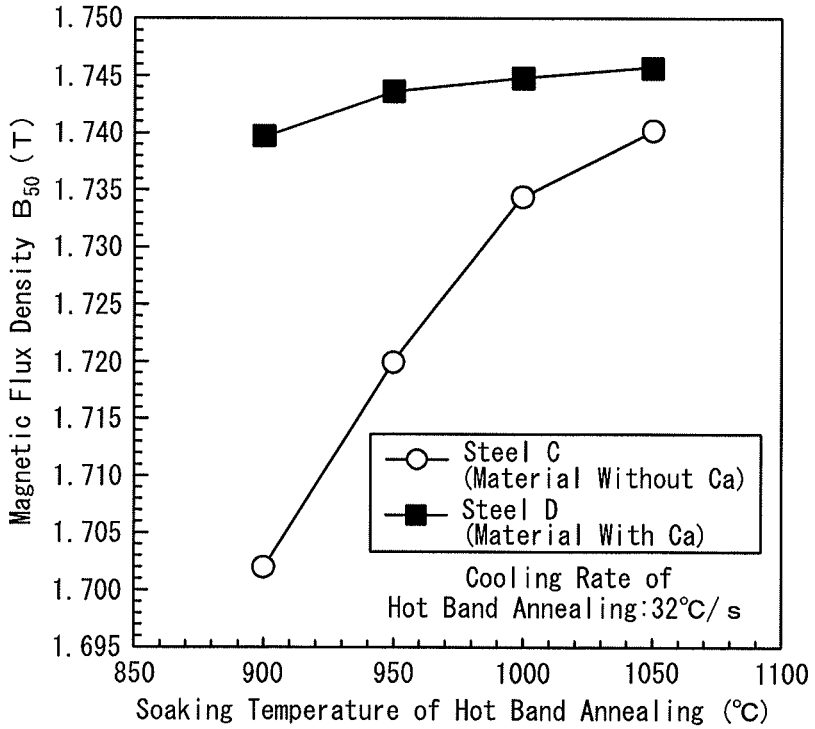
FIG. 4 is a graph indicating the influence of the soaking temperature of hot band annealing on magnetic flux density $B_{50}$.
Figure 5:
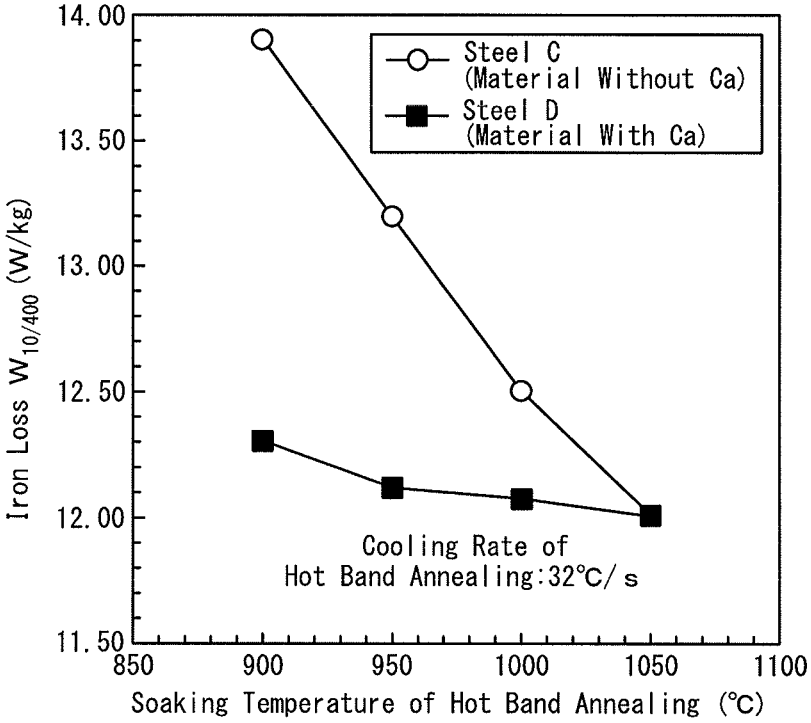
FIG. 5 is a graph indicating the influence of the soaking temperature of hot band annealing on iron loss $W_{10/400}$.

FIGS. 4 and 5 show the results of investigating the influence of the cooling rate of hot band annealing on magnetic flux density $B_{50}$ and iron loss $W_{10/400}$.

As shown in FIGS. 4 and 5, while in material without Ca, soaking temperature dependency of magnetic properties was very strong, in material with Ca, soaking temperature dependency was hardly confirmed.

Although the reason for the above is not necessarily clear, the inventors think as follows.

As previously mentioned, in material with Ca, since fine precipitates such as MnS do not exist, it is considered that the forms of the precipitates would hardly change depending on the soaking temperature, and therefore the grain diameter before cold rolling changes only slightly as shown in FIG. 1. On the other hand, in material without Ca, it is considered that the forms of precipitates would change since fine precipitates such as MnS form a solid solution depending on soaking temperature, and as shown in FIG. 1, as the soaking temperature changes, the grain diameter before cold rolling greatly changes as well. Since the grain diameter before cold rolling has an influence on magnetic properties, it is considered that soaking temperature dependency is strong in material without Ca.

This means that, in the material with Ca of the present invention, there is almost no change in the magnetic properties caused by a change of soaking temperature of hot band annealing, and therefore even in situations where a change of soaking temperature in one coil is 10° C. or more (where the difference between the maximum temperature and the minimum temperature is 10° C. or more), such as a situation where the soaking temperature changed because the preceding or succeeding steel was a different type from the steel in question during continuous annealing, variation in properties would be kept small, and stable magnetic properties can be obtained. Nevertheless, if the variation of soaking temperature exceeds 20° C., the variation in properties becomes large, and therefore the variation of soaking temperature is preferably set to 20° C. or less.

Based on the above finding, experiments using material with Ca were performed multiple times. As a result, in cases where casting of the slab was performed using a curved continuous casting machine, even though sheet breakage did not occur in the hot rolling process, cracks were generated in some of the hot rolled sheets.

Under the situation, the inventors further examined in more detail the manufacturing conditions of the material where cracks were generated in the hot rolled sheet. As a result, as shown in table 2, it was found that the generation ratio of crack is high in hot rolled sheets which had a surface temperature of lower than 700° C. at the center part of slab width when the slab in a curved continuous casting machine is in the straightening zone right after passing through the curved zone.

TABLE 2

| Condition | Surface Temperature of Slab at the Inlet Side of Straightening Zone (° C.) | Number of Cracks Penetrated in Thickness Direction of Hot Rolled Sheet per Coil (number) |
|---|---|---|
| 1 | 635 | 5.9 |
| 2 | 689 | 2.0 |
| 3 | 712 | 0.0 |
| 4 | 761 | 0.0 |

Based on the above finding, the inventors succeeded in developing a method of stably manufacturing a high magnetic flux density electrical steel sheet with excellent magnetic flux density and iron loss properties, at a low cost, and completed the present invention.

Next, the reasons for limiting steel components to said composition range in the present invention will be explained.

C: 0.0050% or Less

Since C deteriorates iron loss properties, the less the C content is, the better. Since if the C content exceeds 0.0050%, the increase in iron loss becomes particularly prominent, the C content is limited to 0.0050% or less. Although the lower limit will not be specified since less C content is more preferable, it is preferable for the lower limit of C content to be around 0.0005%, considering decarburization costs.

Si: More than 3.0% and 5.0% or Less

Not only is Si commonly used as a deoxidizer for steel, but it also has an effect of increasing electric resistance and reducing iron loss, and therefore it is one of the main elements constituting an electrical steel sheet. Since other elements which enhance electric resistance such as Al and Mn are not used in the present invention, Si is positively added to steel as a main element for enhancing electric resistance, in an amount of more than 3.0%. However, if the Si content exceeds 5.0%, manufacturability decreases to such an extent that a crack is generated during cold rolling, and therefore, the upper limit was set to 5.0%. The content of Si is desirably 4.5% or less.

Mn: 0.10% or Less

In order to enhance magnetic flux density, the less Mn content is, the better. Further, Mn is a harmful element that not only interferes with domain wall displacement when precipitated as MnS, but deteriorates magnetic properties by inhibiting crystal grain growth. Therefore, from the viewpoint of magnetic properties, the content of Mn is limited to 0.10% or less. Although the lower limit will not be specified since less Mn content is preferable, it is preferable for the lower limit of Mn content to be around 0.005%.

Al: 0.0010% or Less

Al, as well as Si, is commonly used as a deoxidizer for steel, and has a large effect of increasing electric resistance and reducing iron loss. Therefore, it is one of the main constituent elements of a non-oriented electrical steel sheet. However, in the present invention, in order to enhance the magnetic flux density of the product, the content of Al is limited to 0.0010% or less. Although the lower limit will not be specified since less Al content is more preferable, it is preferable for the lower limit of Al content to be around 0.00005%.

P: More than 0.040% and 0.2% or Less

P has an effect of enhancing magnetic flux density, and an additive amount of more than 0.040% is required in order to obtain such effect. On the other hand, excessively adding P would lead to a decrease in rollability, and therefore the content of P is limited to 0.2% or less.

N: 0.0040% or Less

N, as in the case with the aforementioned C, causes deterioration of magnetic properties, and therefore the content of N is limited to 0.0040% or less. Although the lower limit will not be specified since less N content is preferable, it is preferable for the lower limit of N content to be around 0.0005%.

S: 0.0003% or More and 0.0050% or Less

Since S forms precipitates and inclusions, and deteriorates the magnetic properties of the product, the less S content is, the better. Even though the harmful influence of S is relatively small since Ca is added in the present invention, the content of S is limited to 0.0050% or less in order to prevent magnetic properties from deteriorating. Further, in order to suppress the increase in costs due to desulfurization, the lower limit was set to 0.0003%.

Ca: 0.0015% or More

In the present invention, the content of Mn is smaller compared to normal non-oriented electrical steel sheets, and therefore, Ca fixes S within the steel and prevents generation of FeS in liquid phase, and provides good manufacturability at the time of hot rolling. Further, since the content of Mn is small in the present invention, Ca provides an effect of enhancing magnetic flux density. Further, Ca provides an effect of reducing the variation of magnetic properties caused by the variation of soaking temperature of hot band annealing. In order to obtain the above effects, it is necessary to add 0.0015% or more of Ca. However, since an excessively large additive amount of Ca would cause an increase of Ca-based inclusions such as Ca oxide and may lead to deterioration of iron loss properties, the upper limit is 0.5 preferably set to be around 0.005%.

Total of at Least One Element Selected from Sn and Sb: 0.01% or More and 0.1% or Less Sn and Sb both have an effect of improving the texture and magnetic properties. In order to obtain such effect, it is necessary to add 0.01% or more, in either case of independent addition or combined addition of Sn and Sb. On the other hand, excessively adding these components would cause embrittlement of steel, and increase the possibility of sheet breakage and scabs during manufacture of the steel sheet, and therefore the content of each of Sn and Sb is to be 0.1% or less in either case of independent addition or combined addition.

By applying essential components and inhibiting components such as described above, it is possible to stably manufacture a non-oriented electrical steel sheet with excellent magnetic flux density and iron loss properties, at a low cost.

In the present invention, other elements are preferably reduced to a degree that does not cause any problem in manufacture since they would otherwise deteriorate the magnetic properties of the products.

Next, the reason for limiting the manufacturing method according to the present invention is described.

The manufacturing process of a high magnetic flux density electrical steel sheet of the present invention can be carried out using the process and equipment applied for manufacturing a normal non-oriented electrical steel sheet.

An example of such process would be subjecting a steel, which is obtained by steelmaking in a converter or an electric furnace, etc. so as to have a predetermined chemical composition, to secondary refining in a degassing equipment, and to continuous casting to obtain a steel slab, and then subjecting the steel slab to hot rolling, hot band annealing, pickling, cold rolling, final annealing, and applying and baking insulating coating thereon.

However, in a case where continuous casting is performed using a curved continuous casting machine, the surface temperature at the center part of slab width in the straightening zone right after passing through the curved zone is preferably set to 700° C. or higher. This is because if the surface temperature at the center part of slab width in the straightening zone right after passing through the curved zone is lower than 700° C., cracks in hot rolled sheets tend to generate more easily. The upper limit of the surface temperature at the center part of the slab width is preferably around 900° C. The surface temperature at the center part of the slab width in the straightening zone can be controlled by changing for example, cooling conditions of cooling water in the curved zone.

At the time of hot rolling, the slab reheating temperature is preferably set to 1000° C. or higher and 1200° C. or lower. If the slab reheating temperature becomes high, not only is it uneconomical because of the increase in energy loss, but the high-temperature strength of the slab decreases, which makes it more likely for troubles in manufacture such as sagging of the slab to occur. Therefore, the temperature is preferably set to 1200° C. or lower.

Although the thickness of the hot rolled sheet is not particularly limited, it is preferably 1.5 mm to 2.8 mm, and more preferably 1.7 mm to 2.3 mm.

In the present invention, it is necessary to set the soaking temperature of hot band annealing to 900° C. or higher and 1050° C. or lower. This is because a soaking temperature of hot band annealing of lower than 900° C. leads to deterioration of magnetic properties, while a soaking temperature exceeding 1050° C. is economically disadvantageous. The soaking temperature of hot band annealing is preferably in the range of 950° C. and 1050° C. (inclusive of 950° C. and 1050° C.).

In the present invention, the cooling rate after soaking treatment in the above hot band annealing is especially important. It is necessary to limit the cooling rate in hot band annealing to 5° C./s or more. This is because if the cooling rate of hot band annealing is less than 5° C./s, sheet breakage tends to occur more easily in the subsequent cold rolling. The cooling rate is more preferably 25° C./s or more. Further, the upper limit of the cooling rate is preferably around 100° C./s.

This controlled cooling treatment should be performed at least until reaching 650° C. This is because grain boundary segregation of P becomes prominent at 700° C. to 800° C., and therefore, the above problem would be resolved by performing controlled cooling at least until reaching 650° C. in the above conditions in order to prevent sheet breakage during cold rolling.

As mentioned above, in the present invention, the cooling rate of hot band annealing is set to 5° C./s or more, and therefore continuous annealing is suitable for hot band annealing. Further, continuous annealing is more preferable than box annealing also from the viewpoints of productivity and manufacturing costs.

Here, for example, the cooling rate is calculated by 200 (° C.)+t (s), when t (s) is defined as the time required for cooling from 850° C. to 650° C.

Next, after the above described hot band annealing, a so-called single-stage cold rolling process which achieves a final sheet thickness in a cold rolling process without intermediate annealing, is applied to carry out cold rolling. The single-stage cold rolling process is applied in order to enhance productivity and manufacturability. Cold rolling of twice or more with intermediate annealing performed therebetween would increase manufacturing costs and reduce productivity. Further, if the cold rolling is performed as warm rolling with a sheet temperature of around 200° C., the magnetic flux density will be improved. Therefore, if there is no problem in adaptation of facilities for warm rolling, restrictions of production, and economic efficiency, warm rolling may be performed in the present invention.

Although the thickness of the cold rolled sheet is not particularly limited, it is preferably set to around 0.20 mm to 0.50 mm.

Next, final annealing is performed, and the soaking temperature during this process is preferably 700° C. or higher and 1150° C. or lower. This is because at a soaking temperature of lower than 700° C., recrystallization does not sufficiently proceed and magnetic properties may significantly deteriorate, and a sufficient sheet shape correction effect cannot be achieved during continuous annealing, while if the soaking temperature exceeds 1150° C., the crystal grains become very coarse, and iron loss particularly in the higher frequency range increases.

It is advantageous to apply insulating coating on the surface of the steel sheet after the above described final annealing, in order to reduce iron loss. At this time, in order to ensure good punchability, organic coating containing a resin is preferably applied, while if greater importance is placed on weldability, semi-organic or inorganic coating is preferably applied.

In the present invention, in order to reduce iron loss, Si content is set to be more than 3.0%, and in order to improve magnetic flux density. Al content was very small, Mn content was small, Sn and/or Sb was added, and P was added. However, the combined effect of these procedures is not necessarily clear.

EXAMPLES

Example 1

Steel slabs having the chemical compositions shown in table 3, were subjected to casting using a curved continuous casting machine in the conditions shown in table 4, and then subjected to re-heating, hot rolling, hot band annealing, pickling, then cold rolling to a sheet thickness of 0.25 mm, and subsequent final annealing, also in the conditions shown in table 4.

However, regarding steel sample E, since a sheet breakage was occurred during hot rolling, processes following hot band annealing were not performed. Further, regarding the conditions of steel sample F, a crack was generated in the hot rolled sheet in condition No. 3. On the other hand, in condition Nos. 4 to 7 of steel sample F and condition Nos. 8 to 11 of steel sample G, no cracks were generated in the hot rolled sheets.

In the subsequent cold rolling, sheet breakage occurred in condition No. 4 of steel sample F and condition No. 8 of steel sample G. On the other hand, in condition Nos. 5 to 7 of steel sample F and condition Nos. 9 to 11 of steel sample G, no cracks were generated in the cold rolled sheets.

Further, magnetic properties of the obtained product steel sheets were investigated. Magnetic properties were evaluated based on $B_{50}$ (magnetic flux density at magnetizing force of 5000 A/m) and $W_{10/400}$ (iron loss when excited at magnetic flux density of 1.0 T and frequency of 400 Hz) of (L+C) properties by measuring Epstein test specimens in the rolling direction (L) and the transverse direction (C).

The obtained results are shown in Table 4.

As shown in table 4, when manufacturing in accordance with the present invention, no sheet breakage occurred during hot rolling or cold rolling, and good magnetic properties were obtained.

Example 2

Steel slabs with chemical compositions shown in table 5 were subjected to casting at a surface temperature of 750° C. to 850° C. at the center part of slab width at the entry side of the straightening zone of a curved continuous casting machine, hot rolling at SRT (Slab Reheating Temperature) of 1050° C. to 1110° C. to a thickness of 2.0 mm, continuous annealing as hot band annealing with soaking temperature of hot band annealing of 990° C. and cooling rate of hot band annealing of 30° C./s to 50° C./s, cold rolling to a thickness of 0.25 mm, and subsequent final annealing at a soaking temperature of 1000° C., to manufacture electrical steel sheets. In steel samples J and U, a crack was generated during cold rolling, and therefore the following processes were cancelled.

Regarding the obtained electrical steel sheets, the results of investigation on magnetic properties (L+C properties) are shown in Table 5. The evaluation on magnetic properties was conducted with the same method as example 1.

TABLE 3

| Steel | Chemical Composition (mass %) | | | | | | | | | | |
|---|---|---|---|---|---|---|---|---|---|---|---|
| Sample | C | Si | Mn | Al | P | S | N | Sn | Sb | Ca | Remarks |
| E | 0.0017 | 3.31 | 0.031 | 0.0004 | 0.09 | 0.0018 | 0.0017 | 0.032 | — | — | Comparative Example |
| F | 0.0019 | 3.33 | 0.029 | 0.0004 | 0.09 | 0.0019 | 0.0017 | 0.031 | — | 0.0031 | Inventive Example |
| G | 0.0017 | 3.32 | 0.030 | 0.0004 | 0.09 | 0.0018 | 0.0018 | — | 0.031 | 0.0029 | Inventive Example |

TABLE 4

| No. | Steel Sample | Surface Temperature of Slab at the Entry Side of Straightening Zone (° C.) | Slab Reheating Temperature (° C.) | Thickness of Hot Rolled Sheet (mm) | Soaking Temperature of Hot Band Annealing (° C.) | Cooling Rate of Hot Band Annealing (° C./s) | Final Annealing Temperature (° C.) | $W_{10/400}$ (W/kg) | $B_{50}$ (T) | Remarks |
|---|---|---|---|---|---|---|---|---|---|---|
| 1 | E | 715 | 1095 | 2.0 | Sheet breakage occurred during hot rolling | | | | | Comparative Example |
| 2 | E | 721 | 1108 | 2.0 | Sheet breakage occurred during hot rolling | | | | | Comparative Example |
| 3 | F | 681 | 1077 | 2.0 | 980(*) | 30(*) | 1000 | 12.1 | 1.745 | Inventive Example |
| 4 | F | 716 | 1091 | 2.0 | 980 | 4 | Sheet breakage occurred during cold rolling | | | Comparative Example |
| 5 | F | 735 | 1088 | 2.0 | 980 | 7 | 1000 | 12.3 | 1.744 | Inventive Example |
| 6 | F | 761 | 1112 | 2.0 | 980 | 39 | 1000 | 12.2 | 1.745 | Inventive Example |
| 7 | F | 810 | 1089 | 2.0 | 880 | 71 | 1000 | 12.6 | 1.735 | Comparative Example |
| 8 | G | 817 | 1102 | 2.0 | 980 | 4 | Sheet breakage occurred during cold rolling | | | Comparative Example |
| 9 | G | 711 | 1100 | 2.0 | 980 | 7 | 1000 | 11.9 | 1.745 | Inventive Example |
| 10 | G | 709 | 1084 | 2.0 | 980 | 39 | 1000 | 12.3 | 1.744 | Inventive Example |
| 11 | G | 715 | 1075 | 2.0 | 880 | 71 | 1000 | 12.7 | 1.736 | Comparative Example |

(*)Crack was generated in hot rolled sheet

TABLE 5

| Steel | Chemical Composition (mass %) | | | | | | | | | | $W_{10/400}$ | $B_{50}$ | |
|---|---|---|---|---|---|---|---|---|---|---|---|---|---|
| Sample | C | Si | Mn | Al | P | S | N | Sn | Sb | Ca | (W/kg) | (T) | Remarks |
| H | 0.0020 | 3.32 | 0.025 | 0.0004 | 0.07 | 0.0018 | 0.0019 | 0.033 | — | 0.0030 | 11.9 | 1.739 | Inventive Example |
| I | 0.0018 | 3.33 | 0.022 | 0.0004 | 0.08 | 0.0019 | 0.0017 | — | 0.025 | 0.0028 | 11.8 | 1.744 | Inventive Example |
| J | 0.0017 | 5.21 | 0.031 | 0.0003 | 0.08 | 0.0022 | 0.0018 | 0.035 | — | 0.0032 | Sheet breakage occurred during cold rolling | | Comparative Example |
| K | 0.0017 | 3.91 | 0.033 | 0.0003 | 0.09 | 0.0017 | 0.0020 | 0.029 | — | 0.0029 | 10.9 | 1.737 | Inventive Example |
| L | 0.0015 | 2.70 | 0.026 | 0.0006 | 0.08 | 0.0016 | 0.0017 | 0.025 | — | 0.0036 | 13.5 | 1.758 | Comparative Example |
| M | 0.0019 | 3.26 | 0.055 | 0.0004 | 0.11 | 0.0023 | 0.0032 | 0.027 | 0.016 | 0.0018 | 12.3 | 1.740 | Inventive Example |
| N | 0.0022 | 3.30 | 0.125 | 0.0007 | 0.08 | 0.0020 | 0.0022 | 0.031 | 0.021 | 0.0018 | 12.2 | 1.729 | Comparative Example |
| O | 0.0020 | 3.28 | 0.044 | 0.0006 | 0.09 | 0.0021 | 0.0022 | 0.051 | — | 0.0022 | 12.0 | 1.746 | Inventive Example |
| P | 0.0018 | 3.35 | 0.037 | 0.0015 | 0.08 | 0.0021 | 0.0026 | 0.042 | — | 0.0029 | 13.3 | 1.724 | Comparative Example |
| Q | 0.0016 | 3.28 | 0.031 | 0.0005 | 0.11 | 0.0055 | 0.0021 | — | 0.026 | 0.0027 | 13.1 | 1.728 | Comparative Example |
| R | 0.0018 | 3.29 | 0.025 | 0.0004 | 0.03 | 0.0019 | 0.0021 | 0.039 | — | 0.0022 | 12.1 | 1.724 | Comparative Example |
| S | 0.0019 | 3.30 | 0.002 | 0.0005 | 0.05 | 0.0018 | 0.0019 | 0.035 | — | 0.0031 | 12.2 | 1.738 | Inventive Example |
| T | 0.0021 | 3.31 | 0.022 | 0.0002 | 0.15 | 0.0018 | 0.0014 | 0.037 | — | 0.0029 | 11.6 | 1.761 | Inventive Example |
| U | 0.0017 | 3.32 | 0.028 | 0.0060 | 0.26 | 0.0020 | 0.0023 | 0.033 | — | 0.0034 | Sheet breakage occurred during cold rolling | | Comparative Example |

As it is clear from table 5, in all of the inventive examples satisfying the chemical composition of the present invention, $W_{10/400}$ is 12.3 W/kg or less and $B_{50}$ is 1.737 T or more, and they show good magnetic properties.

Example 3

Steel slabs with chemical compositions shown in table 6 were subjected to casting at a surface temperature of 770° C. at the center part of slab width at the entry side of the straightening zone of a curved continuous casting machine, hot rolling at SRT (Slab Reheating Temperature) of 1090° C. to a thickness of 2.0 mm, continuous annealing as hot band annealing with soaking temperature of hot band annealing of 950° C. to 990° C. and cooling rate of hot band annealing of 47° C./s, cold rolling to a thickness of 0.25 mm, and subsequent final annealing at a soaking temperature of 1000° C., to manufacture electrical steel sheets. The soaking temperature of hot band annealing is set to 950° C. in the lead end of each hot rolled sheet coil, and then the temperature is increased and set to 990° C. in the tail end of the hot rolled sheet coil.

Regarding the obtained electrical steel sheets, the results of investigation on magnetic properties (L+C properties) are shown in Table 7. The evaluation was conducted with the same method as example 1.

TABLE 6

| Steel | Chemical Composition (mass %) | | | | | | | | | |
|---|---|---|---|---|---|---|---|---|---|---|
| Sample | C | Si | Mn | Al | P | S | N | Sn | Ca | Remarks |
| V | 0.0016 | 3.3 | 0.25 | 0.0004 | 0.09 | 0.0017 | 0.0015 | 0.03 | — | Comparative Example |
| W | 0.0017 | 3.3 | 0.03 | 0.0004 | 0.09 | 0.0016 | 0.0016 | 0.03 | 0.003 | Inventive Example |

TABLE 7

| | Lead End of the Hot Rolled Sheet Coil | | Tail End of the Hot Rolled Sheet Coil | | |
|---|---|---|---|---|---|
| Steel Sample | $W_{10:400}$ (W/kg) | $B_{50}$ (T) | $W_{10:400}$ (W/kg) | $B_{50}$ (T) | Remarks |
| V | 13.3 | 1.721 | 12.5 | 1.736 | Comparative Example |
| W | 12.2 | 1.744 | 12.2 | 1.745 | Inventive Example |

As it is clear from table 7, it has been confirmed in all of the inventive examples satisfying the chemical composition of the present invention, that there is hardly any variation in magnetic properties despite the variation in hot band annealing temperature, and that they have excellent manufacturing stability.

The invention claimed is:

1. A method for manufacturing a non-oriented electrical steel sheet, the method comprising:

casting in a continuous casting machine a slab having a chemical composition comprising, by mass %:

C: 0.0050% or less;

Si: more than 3.0% to 5.0% or less;

Mn: 0.10% or less;
Al: 0.0010% or less;
P: more than 0.040% and to 0.2% or less;
N: 0.0040% or less;
S: 0.0003% or more to 0.0050% or less;
Ca: 0.0015% or more;
a total of at least one element selected from the group consisting of Sn and Sb: 0.01% or more to 0.1% or less; and
the balance including Fe and incidental, impurities;
subjecting the slab to heating;
then subjecting the slab to hot rolling to obtain a hot rolled steel sheet;
then subjecting the steel sheet to hot band annealing, pickling, and subsequent single cold rolling to obtain a final sheet thickness;
then subjecting the steel sheet to final annealing,
wherein in the hot band annealing, a soaking temperature is 900° C. or higher to 1050° C. or lower, and a cooling rate after soaking is 5° C./s or more.

2. The method for manufacturing a non-oriented electrical steel sheet according to claim 1, wherein if the continuous casting machine is a curved continuous casting machine, a surface temperature at a center part of a slab width in a straightening zone right after the slab passes through a curved zone is set to be 700° C. or higher.

3. The method for manufacturing a non-oriented electrical steel sheet according to claim 1, wherein the hot band annealing is performed as continuous annealing, and a difference between a maximum temperature and a minimum temperature of soaking temperature in a hot rolled sheet coil is 10° C. or more.

4. The method for manufacturing a non-oriented electrical steel sheet according to claim 2, wherein the hot band annealing is performed as continuous annealing, and a difference between a maximum temperature and a minimum temperature of soaking temperature in a hot rolled sheet coil is 10° C. or more.

5. The method for manufacturing a non-oriented electrical steel sheet according to claim 1, wherein the cooling rate after soaking is 25° C./s or more.

* * * * *